US012090545B2

(12) United States Patent
Liang et al.

(10) Patent No.: US 12,090,545 B2
(45) Date of Patent: Sep. 17, 2024

(54) RISER TUBE COATING FOR CAST ALUMINUM ALLOY AND USING METHOD THEREOF

(71) Applicant: CITIC Dicastal Co., Ltd., Qinhuangdao (CN)

(72) Inventors: Xin Liang, Qinhuangdao (CN); Bangwei Bai, Qinhuangdao (CN); Haifeng Liu, Qinhuangdao (CN); Peng Qin, Qinhuangdao (CN); Hongren Zhang, Qinhuangdao (CN); Liming Xie, Qinhuangdao (CN); Chao Ma, Qinhuangdao (CN); Baoshui Ma, Qinhuangdao (CN); Ji Wang, Qinhuangdao (CN); Bao Zhang, Qinhuangdao (CN)

(73) Assignees: CITIC Dicastal Co., Ltd., Qinhuangdao (CN); CITIC CO., LIMITED, Beijing (CN)

( * ) Notice: Subject to any disclaimer, the term of this patent is extended or adjusted under 35 U.S.C. 154(b) by 0 days.

(21) Appl. No.: 18/198,039

(22) Filed: May 16, 2023

(65) Prior Publication Data

US 2023/0381853 A1 Nov. 30, 2023

(30) Foreign Application Priority Data

May 30, 2022 (CN) ..... 202210598691.4

(51) Int. Cl.

| | |
|---|---|
| ***B22C 3/00*** | (2006.01) |
| ***B22C 9/08*** | (2006.01) |
| ***B22D 18/04*** | (2006.01) |

(52) U.S. Cl.
CPC ..... *B22C 3/00* (2013.01); *B22C 9/08* (2013.01); *B22D 18/04* (2013.01)

(58) Field of Classification Search
CPC .. B22C 3/00; B22C 9/08; B22D 18/04; B22D 18/06
See application file for complete search history.

(56) References Cited

U.S. PATENT DOCUMENTS 5,690,759 A * 11/1997 Wang ..... B22C 3/00 164/138
2010/0237224 A1* 9/2010 Laudenklos ..... B22D 17/2209 106/38.22

FOREIGN PATENT DOCUMENTS

CN 109940152 A * 6/2019

OTHER PUBLICATIONS

Clarivate Analytics machine translation of CN 109940152 (Year: 2019).*

* cited by examiner

*Primary Examiner* — Kevin E Yoon
(74) *Attorney, Agent, or Firm* — IPro, PLLC

(57) ABSTRACT

A riser tube coating for a cast aluminum alloy includes a coating-riser tube contact layer material and a coating-aluminum liquid contact layer material. The present invention has a coating protection effect to the maximum mainly by designing ratios of ZrO, $Al_2O_3$, ZnO, binders and other materials and a coat drying heat treatment process, and finally realizes effects of protecting a riser tube, being free of aluminum sticking and prolonging a service life.

5 Claims, 1 Drawing Sheet

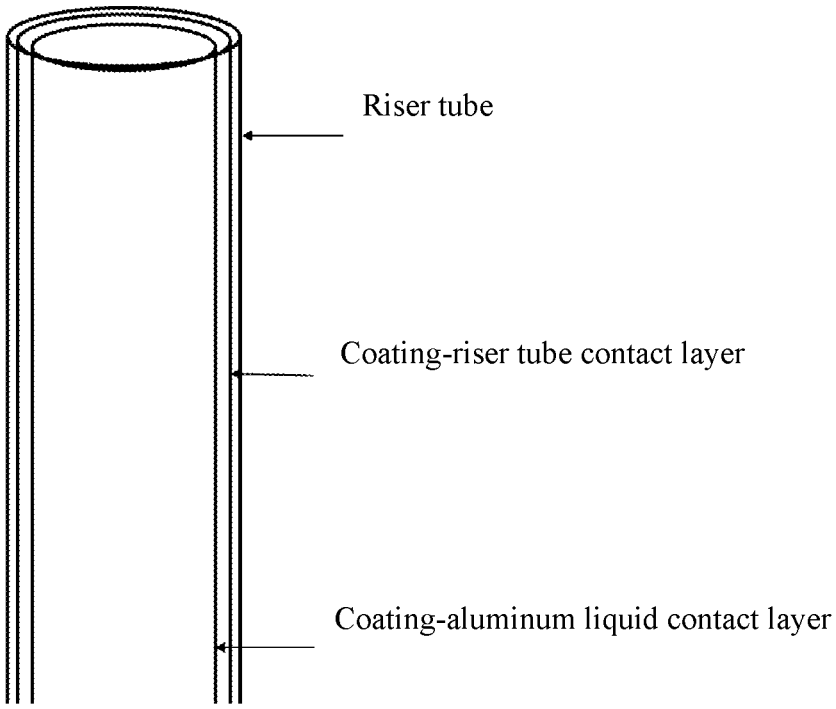
Riser tube
Coating-riser tube contact layer
Coating-aluminum liquid contact layer

RISER TUBE COATING FOR CAST ALUMINUM ALLOY AND USING METHOD THEREOF

TECHNICAL FIELD

The present invention relates to the field of aluminum alloy casting, in particular to a riser tube coating for a cast aluminum alloy and a using method thereof.

BACKGROUND

At present, energy regeneration, resource sustainability, environmental protection and other aspects are facing very severe challenges, aerospace, heavy industry, transportation and other fields solve energy consumption and environmental problems through lightweight. As a major lightweight material, an aluminum alloy plays a very important role in reducing automobile emissions and saving energy. At the same time, the aluminum alloy has good electrical and thermal conductivity, corrosion resistance and good casting performance, which makes its application in engineering structural materials being increasingly expanding.

The demand for lightweight aluminum alloy materials is greater and greater with the development of industry. In all aluminum alloy products, cast aluminum alloy accounts for up to 68.5%. A cast aluminum alloy molding process is simple and has a low demand for a device, and because of good fluidity of the aluminum alloy, aluminum alloy castings in various shapes may be casted. At present, main preparation methods of the aluminum alloy castings mainly include gravity casting, low pressure casting, differential pressure casting, high pressure casting, etc. Due to high requirements of a safety structural component in an aluminum alloy part for an automobile on performance, appearance, etc., low pressure casting, differential pressure casting, and other methods are generally adopted. Low pressure casting and differential pressure casting fall within antigravity casting, the antigravity casting is a casting forming process developed in the 1950s, and the antigravity casting is mainly a method that metal liquid in a crucible or holding furnace overcomes gravity and other resistance along a riser tube from bottom to top under the action of pressure to fill a mold, and a casting is obtained under pressure. With the development of a casting technology and the improvement of casting product quality requirements, a scope of the antigravity casting is constantly expanding at present from simple castings to thin-wall complex castings. In the process of the antigravity casting, a riser tube is a key component, during mold filling, under the action of air pressure, the metal liquid enters the mold from the crucible or holding furnace through the riser tube; and during pressure relief, the unsolidified metal liquid also flows back to the crucible through the riser tube. As an important component of a pouring system, the riser tube has functions of diversion and replenishment, so the riser tube should have good heat resistance and chemical stability to ensure that the metal liquid can complete the mold filling and backflow process.

At present, metal and ceramic riser tubes are generally used in the antigravity casting process of the cast aluminum alloy. The metal liquid riser tube has a small range of use due to its poor heat resistance, poor thermal impact, pollution to aluminum liquid, short life, difficult replacement and other shortcomings. A material of the ceramic riser tube mainly used by aluminum alloy casting generally adopts aluminum titanate, silicon nitride combined with silicon carbide, etc., due to easy decomposition at a high temperature, poor high temperature thermal shock resistance, poor material mechanical properties, frangibility, easy slag hanging, high cost, and other characteristics of a ceramic material, the quality and cost of the cast aluminum alloy products are seriously affected, and a waste riser tube is difficult to decompose and reuse, causing serious environmental pollution. Therefore, a riser tube coating has become the focus of scholars at home and abroad.

In the process of antigravity casting of high temperature aluminum liquid, the metal liquid enters a casting mold from the crucible or holding furnace through the riser tube under the action of pressure. Due to the action of gas pressure and high temperature metal liquid, the riser tube is repeatedly scoured by the metal liquid, in this process, an interface between the riser tube and the metal liquid is seriously eroded, and part of a material of the riser tube will fall off and enter the metal liquid; then, due to the oxidation of the high temperature metal liquid in contact with the air, it adheres to an inner wall and an outer wall of the riser tube, resulting in the shortening of the life of the riser tube; and once again, slag inclusions inside the high temperature molten metal liquid are easily bonded to the inner wall of the riser tube due to repeated scouring in the riser tube, resulting in the blockage of the riser tube, affecting the pressure and turbulent state during the metal liquid flushing into the mold formation, causing defects such as insufficient filling and shrinkage, and ultimately affecting the production efficiency of a factory. Studies at home and abroad have found that there is a serious aluminum sticking phenomenon in the inner wall of the riser tube, due to an oxidation reaction of the material of the riser tube in the long-term contact process with the high temperature aluminum liquid, a wetting angle of the material begins to become smaller, which eventually leads to serious aluminum sticking on the inner wall of the riser tube and difficulty in cleaning, there are more and more slag inclusions in the aluminum liquid of the crucible or the holding furnace, and meanwhile the life of the riser tube is seriously shortened. A statistics result of the aluminum alloy casting factory shows that the weight of aluminum sticking on the inner wall of the riser tube is as high as 3-5 Kg; and the life of aluminum is reduced by about ⅕ because of the riser tube slag, and the yield of aluminum alloy castings is reduced by 1%-2%. Therefore, it is necessary to invent a riser tube coating resistant to high temperature, resistant to thermal impact, free of aluminum sticking, good in protection and environmentally-friendly.

SUMMARY

In view of this, the present invention aims to provide a riser tube coating for a cast aluminum alloy and a using method thereof, and in order to solve the problems such as serious aluminum sticking on the inner wall, short life, casting defect increasing and environmental pollution in the process of using a riser tube for the cast aluminum alloy, the riser tube coating resistant to high temperature, resistant to thermal impact, free of aluminum sticking, good in protection and environmentally-friendly and a using method thereof are put forward.

In order to achieve the above aims, the technical solution of the present invention is achieved as follows:

a riser tube coating for a cast aluminum alloy includes a coating-riser tube contact layer material and a coating-aluminum liquid contact layer material, wherein the coating-riser tube contact layer material includes $ZrO_2$, $Al_2O_3$, ZnO and a binder, $ZrO_2$ accounts for 70%-80%, $Al_2O_3$ accounts for 10%-15%, ZnO accounts for 10%-15%, and a weight ratio of the binder to the materials is 10:1; and the coating-aluminum liquid contact layer material is mainly $ZrO_2$, $Al_2O_3$, ZnO and a binder, the $ZrO_2$ in the coating-aluminum liquid contact layer material accounts for 80%-90%, $Al_2O_3$ accounts for 5%-10%, ZnO accounts for 5%-10%, and a weight ratio of the binder to the materials is 15:1.

In some embodiments, $ZrO_2$ in the coating-riser tube contact layer material is of a particle structure, a particle size is 50 μm-70 μm, $Al_2O_3$ is of a particle structure, a particle size is 40 μm-60 μm, ZnO is of a particle structure, and a particle size is 40 μm-60 μm.

In some embodiments, a thickness of the coating-riser tube contact layer material is 0.5 mm-1.0 mm.

In some embodiments, $ZrO_2$ in the coating-aluminum liquid contact layer material is of a particle structure, a particle size is 30 μm-50 μm, $Al_2O_3$ is of a particle structure, a particle size is 20 μm-30 μm, ZnO is of a particle structure, and a particle size is 20 μm-30 μm.

In some embodiments, a thickness of the coating-aluminum liquid contact layer material is 1.0 mm-1.5 mm.

In some embodiments, coating drying is mainly divided into two stages of drying, and parameters of a first-stage drying heat treatment process are holding temperature being 250° C.-350° C. and holding time being 5 h-6 h; and parameters of a second-stage drying heat treatment process are holding temperature being 300° C.-400° C. and holding time being 2 h-3 h.

Substantive features of the present invention are:

at present, in the production process of antigravity casting of the cast aluminum alloy, the high temperature metal liquid in the crucible or the holding furnace enters a mold cavity through the riser tube under the action of the gas pressure, the metal liquid stays in the riser tube for a period of time in a pressure maintaining stage, and with the pressure relief of the gas in the crucible or the holding furnace, the metal liquid in the riser tube will flow into the crucible or the holding furnace again. In a mold filling process, the high temperature metal liquid at 700° C.-760° C. enters the riser tube from the crucible or the holding furnace, and forms thermal impact on the inner wall of the riser tube, which easily causes cracking and thermal erosion of the riser tube. In the pressure maintaining stage, the metal liquid in the riser tube reacts with the inner wall of the riser tube under the action of pressure, and the slag inclusions in the metal liquid easily bond to the inner wall of the riser tube to form slagging due to the large internal roughness of the riser tube, resulting in the aluminum sticking inside the riser tube to block the aluminum liquid mold filling. Because the metal liquid reacts at a high temperature and forms aluminum sticking, subsequent cleaning of the riser tube requires high temperature baking and is very difficult, which seriously increases the labor intensity and production cost. In the process of pressure relief, the high temperature aluminum liquid in the riser tube flows back to the crucible or the holding furnace, and the residual metal liquid in the riser tube is oxidized quickly after making contact with the air, and stuck to the inside of the riser tube. Because an oxidation layer is thin and a coefficient of thermal expansion is different from that in the riser tube, in the next process of the high temperature aluminum liquid entering the riser tube, the oxidation layer is prone to falling off and mixed into the aluminum liquid, resulting in slag inclusion forming, shrinkage and other defects. In the long-term use process of the riser tube, due to continuous thermal shock, thermal erosion, aluminum sticking on the tube wall, slag hanging and other problems, resulting in the thicker and thicker slag inclusions on the inner wall of the riser tube, internal cracks are increased, the quality of castings is finally affected, and the riser tube needs to be replaced.

A coating-riser tube contact layer of the present invention takes $ZrO_2$, $Al_2O_3$ and ZnO as main materials, $ZrO_2$ accounts for 70%-80%, which fully guarantees effects of being free of aluminum sticking and thermal impact resistance in the riser tube. As is known to all, $ZrO_2$ and aluminum alloy liquid do not react or wet, a melting point of $ZrO_2$ is about 2680° C., a high temperature chemical property is stable, thermal impact resistance performance is good, oxidation resistance is strong, thermal shock resistance is strong, and $ZrO_2$ is non-volatile in high temperature environment, and does not produce toxic and harmful substances. A wetting angle between $ZrO_2$ and the aluminum liquid is close to 180°, according to the knowledge of the wetting angle of a solid-liquid interface, when the wetting angle is 0°, it means complete wetting, and when the wetting angle is 180°, it means no wetting at all. As a material in contact with the aluminum liquid, it must be ensured that the material is not wet with the aluminum liquid, otherwise it easily produces aluminum slag bonding on the inner wall of the riser tube, and therefore, the riser tube coating with $ZrO_2$ as the main material is the biggest difference from other coatings.

In the present invention, the ratios of the materials used in the coating-riser tube contact layer and the coating-aluminum liquid contact layer are different. In the coating-riser tube contact layer, $ZrO_2$ accounts for 70%-80%, $Al_2O_3$ accounts for 10%-15%, ZnO accounts for 10%-15%, and the weight ratio of the binder to the materials is 10:1. In the coating-aluminum liquid contact layer, $ZrO_2$ accounts for 80%-90%, $Al_2O_3$ accounts for 5%-10%, ZnO accounts for is 5%-10%, and the weight ratio of the binder to the materials is 15:1. In the coating-riser tube contact layer, a proportion of a high temperature resistant material is high, a proportion of the binder is small, and the viscosity of the coating is larger in the process of use, it can fully ensure that the high temperature resistant material in the coating is combined with the inner wall of the riser tube, and a protective layer is formed on the inner wall of the riser tube. Then, the proportion of $ZrO_2$ in the coating-riser tube contact layer is high, which can fully ensure the thermal shock resistance of the riser tube after the high temperature metal liquid flushes into it and absence of tiny internal cracks. In the coating-aluminum liquid contact layer, the proportion of the high temperature resistant material is high as well, and at the same time, the proportion of the binder is large, which makes the viscosity of the coating slightly lower, so that the coating can be completely covered on the coating-riser tube contact layer. A higher-proportion high temperature resistant material can ensure that the coating cannot react in a process of making contact with the aluminum liquid contact process to form slagging, aluminum slag bonding and other phenomena.

In the present invention, diameters of $ZrO_2$, $Al_2O_3$ and ZnO particles in the coating-riser tube contact layer and the coating-aluminum liquid contact layer are different. In the coating-riser tube contact layer, $ZrO_2$ is of the particle structure, the particle size is 50 μm-70 μm, $Al_2O_3$ is of the particle structure, the particle size is 40 μm-60 μm, ZnO is of the particle structure, and the particle size is 40 μm-60

μm. $ZrO_2$, $Al_2O_3$, ZnO particles have smaller diameters, and a specific surface area of the particles is larger than that of particles of other coatings, the particles are fully in contact with the binder, a viscous film is formed on the surface of the particles and bonded with the inner wall of the riser tube, bonding force is form, and cracking, peeling and other phenomena are prevented from appearing in the coating-riser tube contact layer under thermal impact of the high temperature metal liquid. In the coating-aluminum liquid contact layer, $ZrO_2$ is of the particle structure, the particle size is 30 μm-50 μm, $Al_2O_3$ is of the particle structure, the particle size of 20 μm-30 μm, ZnO is of the particle structure, and the particle size is 20 μm-30 μm. $ZrO_2$, $Al_2O_3$ and ZnO particles have smaller diameters and larger specific surface areas, and the particles may have good bonding force with the coating-riser tube contact layer to form a protective layer; then, the $ZrO_2$, $Al_2O_3$ and ZnO particles in the coating-aluminum liquid contact layer have small diameters and can be filled in gaps of the particles in the coating-riser tube contact layer to prevent the infiltration of the aluminum liquid in the riser tube in the pressure maintaining stage. Due to the different diameters of the $ZrO_2$, $Al_2O_3$ and ZnO particles in the coating-riser tube contact layer and the coating-aluminum liquid contact layer, the particles with the small diameters in the coating-aluminum liquid contact layer can fill the gaps in the coating-riser tube contact layer, a dense and fully covered protective layer is formed at an interface of the coating-riser tube contact layer and the coating-aluminum liquid contact layer to prevent the aluminum liquid from permeating into the coating-riser tube contact layer, meanwhile, a heat insulation layer may also be formed to effectively block heat in the high temperature metal liquid from forming thermal impact on the coating-riser tube contact layer through the coating-aluminum liquid contact layer, so as to protect the riser tube to prolong the life of the riser tube. Finally, since the $ZrO_2$, $Al_2O_3$ and ZnO particles in the coating-aluminum liquid contact layer are small in diameter, a large number of spherical surfaces are formed on the surface of the coating-aluminum liquid contact layer and may be approximately regarded as smooth planes, and in the reaction process of the high temperature aluminum liquid and the coating-aluminum liquid contact layer, the smooth planes are not beneficial to formation of the sticking slag in the aluminum liquid. Similarly, after pressure relief of the crucible or the holding furnace, the aluminum liquid on the surface of the coating-aluminum liquid contact layer in the riser tube is oxidized by making contact with the air, it is not easily stuck to the coating-aluminum liquid contact layer, and it is ensured that the riser tube is free of aluminum sticking and does not form slagging.

In the present invention, thickness requirements of the coating-riser tube contact layer and the coating-aluminum liquid contact layer are different. A painting thickness of the coating-riser tube contact layer is required to be 0.5 mm-1.0 mm, and a painting thickness of the coating-aluminum liquid contact layer is required to be 1.0 mm-1.5 mm. The coating-riser tube contact layer mainly plays a protective role on the riser tube, and reduces the impact of the high temperature metal liquid on the riser tube in a heat blocking mode to ensure that the riser tube does not crack. The $ZrO_2$, $Al_2O_3$ and ZnO particles in the coating-riser tube contact layer have large diameters, in the process of heat transfer, the $ZrO_2$, $Al_2O_3$ and ZnO particles will perform heat conduction, and due to the large diameters of the particles, the heat loss in the heat conduction process is large, which can reduce the thermal shock. However, this thermal shock reduction effect of the coating-riser tube contact layer requires ensuring that the coating-aluminum liquid contact layer has an appropriate thickness. From the theoretical analysis, the greater the thickness of the coating-riser tube contact layer, the greater the heat loss in the heat conduction process, however, the greater the thickness, the greater the difference between a linear expansion coefficient of the coating-riser tube contact layer and a linear expansion coefficient of the inner wall of the riser tube, the difference will reduce the bonding force of the coating-riser tube contact layer, resulting in coating stripping, peeling and other phenomena, and therefore the thickness of the coating-riser tube contact layer should be 0.5 mm-1.0 mm. The coating-aluminum liquid contact layer makes direct contact with the high temperature metal liquid, and repeated scouring of the high temperature metal liquid in the riser tube needs protection of the coating-aluminum liquid contact layer on the riser tube. The thickness of the coating-aluminum liquid contact layer is 1.0 mm-1.5 mm, which can block contact of the metal liquid and the riser tube, and it is ensured that in the repeated scouring process, the surface of the coating-aluminum liquid contact layer is dense and free of damage. The $ZrO_2$, $Al_2O_3$ and ZnO particles in the coating-aluminum liquid contact layer are small in diameter, under the condition that the thickness of the coating-aluminum liquid contact layer is 1.0 mm-1.5 mm, the frequency of coating painting is larger if the complete coating-aluminum liquid contact layer needs to be formed, therefore, it may be ensured that there are more coating layers in the coating-aluminum liquid contact layer, when the high temperature metal liquid passes through the coating-aluminum liquid contact layer, the high temperature metal liquid needs to pass through more coating layers, heat exchange is formed between every two coating layers, which loses a large number of heat, and the impact on the riser tube is reduced.

A coating drying process of the present invention is divided into two stages, and the parameters of the first-stage drying heat treatment process are holding temperature being 250° C.-350° C. and holding time being 5 h-6 h; and the parameters of the second-stage drying heat treatment process are holding temperature being 300° C.-400° C. and holding time being 2 h-3 h. The inner wall of the riser tube needs to be dried after coating painting. Because the material and the binder in the coating of the present invention are different from those in other coatings, the coating of the present invention needs matching drying heat treatment process parameters. The parameters of the first-stage drying heat treatment process are the holding temperature being 250° C.-350° C. and the holding time being 5 h-6 h, long-time holding is performed on the coating in the riser tube in a warm box at the temperature of 250° C.-350° C., it may be ensured that water in the riser tube and the coating is fully evaporated, and through low-temperature long-time heat preservation, the materials and the binders in the coating-riser tube contact layer and the coating-aluminum liquid contact layer are fully preheated. The parameters of the second-stage drying heat treatment process are the holding temperature being 300° C.-400° C. and the holding time being 2 h-3 h. At the high temperature environment, the $ZrO_2$, $Al_2O_3$, ZnO particles and the binders in the coating fully react to form the dense protective layer, and the inner wall of the riser tube and the coating-riser tube contact layer, and the coating-riser tube contact layer and the coating-aluminum liquid contact layer may be well bonded to form firm protective layers.

Compared with the prior art, the riser tube coating for the cast aluminum alloy and the using method thereof of the present invention have following advantages:

at present, in the production process of antigravity casting of the cast aluminum alloy, the high temperature metal liquid in the crucible or the holding furnace enters the mold cavity through the riser tube under the action of the gas pressure, the metal liquid stays in the riser tube for the period of time in the pressure maintaining stage, and with the pressure relief of the gas in the crucible or the holding furnace, the metal liquid in the riser tube will flow into the crucible or the holding furnace again. The metal liquid enters the riser tube, and forms thermal impact on the inner wall of the riser tube, which easily causes cracking and thermal erosion of the riser tube. In this process, the interface of the riser tube and the metal liquid is seriously eroded, and part of the riser tube material will fall and enter the metal liquid; then the high temperature metal liquid is oxidized due to making contact with the air, and stuck to the inner wall and the outer wall of the riser tube, resulting in reduction of the life of the riser tube; and once again, the slag inclusions inside the high-temperature molten metal are prone to bonding to the inner wall of the riser tube due to repeated scouring in the riser tube. Because the metal liquid reacts in a high-temperature situation and forms aluminum sticking, subsequent cleaning of the riser tube needs high-temperature baking, cleaning is very difficult, and labor intensity and production cost are seriously increased. For solving the above problems, the present invention provides the riser tube coating resistant to high temperature, resistant to thermal impact, free of aluminum sticking, good in protection and environmentally-friendly.

(1), $ZrO_2$, $Al_2O_3$, ZnO, the binder and other materials used in the present invention have a high melting point and are easily prepared into the coating. Through design of parameters such as a shape, a size and a proportion of the materials, it can be ensured that the coating has a protective effect on the riser tube. According to the statistics, under the current production process conditions, a riser tube without the coating needs to be disassembled and cleaned every 5 days, and the accumulated service life is about 60 days. However, the riser tube treated by the coating and a baking method designed by the present invention should be cleaned after 10 days, the coating is painted again, and the accumulated service life can reach 110 days. After calculating the price and life of the riser tube used by the factory, the monthly cost of the riser tube can be saved by about 48,000 yuan. Therefore, it can be illustrated that the present invention has good protection, life prolonging and cost saving effects on the riser tube.

(2), by applying the coating designed in the present invention to brush the riser tube and performing baking according to the baking process, inner wall slag hanging of the riser tube can be effectively reduced, and the removal of the inner wall hanging slag does not require high temperature heating, so as to greatly improve the working environment and reduce labor intensity. By comparing an aluminum sticking weight of the riser tube without using the coating with that of the riser tube using the coating of the present invention, it may be found that the weight of the riser tube without using the coating is increased by about 2.8 Kg when scrapped, and the weight of the riser tube using the coating of the present invention is increased by 0.4 Kg when scrapped. Accordingly, it may be seen that the coating of the present invention can prevent the aluminum slag from sticking in the inside of the riser tube and reduce the mass loss of the aluminum liquid. There is a difference in cleaning time between the riser tube without using the coating and the riser tube using the coating of the present invention. The riser tube without using the coating needs to be roasted at a high temperature for 4 h and cleaned for 2 h. The riser tube using the coating of the present invention does not need high temperature baking in the cleaning process, and the cleaning time is 30 min. Therefore, the coating designed by the present invention can achieve the effects of being free of aluminum sticking on the inner wall of the riser tube, reducing slagging, saving cost and being environmentally friendly.

(3), the materials in the coating designed in the present invention and a device used in the baking process are conventional materials. The production process of the refractory materials is mature and stable, so the cost of the riser tube will not be increased. Therefore, the present invention has the advantages of easy realization, economy and practicality.

BRIEF DESCRIPTION OF THE DRAWINGS

Accompanying drawings forming part of the present invention are used to provide further understanding of the present invention, and schematic embodiments and descriptions thereof of the present invention are used to explain the present invention and do not constitute undue limitation to the present invention. In the accompanying drawings:

FIG. 1 is a schematic diagram of a riser tube coating for a cast aluminum alloy of the present invention.

DETAILED DESCRIPTION

It should be noted that embodiments and features in the embodiments of the present invention may be combined with each other without conflict. The technical solution of the present invention is clearly and completely described below in combination with FIG. 1 and embodiments. Obviously, the embodiments described are only part of the embodiments of the present invention, but not all embodiments. All other embodiments obtained by those ordinarily skilled in the art on the basis of the embodiments in the present invention without creative labor fall within the scope of protection of the present invention.

A riser tube coating for a cast aluminum alloy and a using method thereof of the embodiments of the present invention are described below in combination with the embodiments. Materials of the coating are mainly $ZrO_2$, $Al_2O_3$, ZnO, a binder and so on. The present invention has a protection effect on the coating to the maximum mainly by designing ratios of ZrO, $Al_2O_3$, ZnO, the binder and other materials and a coat drying heat treatment process, and finally realizes effects of protecting a riser tube, being free of aluminum sticking and prolonging the service life. The coating has significant effects of being protective, being free of aluminum sticking and prolonging life of a riser tube and is an environmentally-friendly coating with good protectiveness.

EMBODIMENT 1

Embodiments of the present invention provide a riser tube coating for a cast aluminum alloy and a using method thereof. A coating material is mainly composed of $ZrO_2$, $Al_2O_3$, ZnO and a binder, and proportions of which are weight percentages.

A coating-riser tube contact layer material is mainly $ZrO_2$, $Al_2O_3$, ZnO and a binder, $ZrO_2$ is of a particle structure, a particle size is 50 μm, $Al_2O_3$ is of a particle structure, a particle size is 40 μm, ZnO is of a particle structure, and a particle size is 40 μm. In a coating-riser tube contact layer, $ZrO_2$ accounts for 70%, $Al_2O_3$ accounts for 15%, ZnO accounts for 15%, a weight ratio of the binder to the materials is 10:1, and a painting thickness of the whole coating-riser tube contact layer is required to be 0.5 mm.

The above specified materials are put into a mixing bucket for preliminary mixing, a rotation speed of a mixer is 200 revolutions per minute to obtain a preliminarily-mixed material, then, the obtained preliminarily-mixed material is rapidly mixed, the binder needs to be added in a rapid mixing stage, the weight ratio of the binder to the materials is 10:1, the rotation speed of the mixer is 300 revolutions per minute to obtain a coating-riser tube contact layer coating, the coating is used for painting the riser tube, and a coating thickness is 0.5 mm.

A coating-aluminum liquid contact layer material is mainly $ZrO_2$, $Al_2O_3$, ZnO and a binder, $ZrO_2$ is of a particle structure, a particle size is 30 μm, $Al_2O_3$ is of a particle structure, a particle size is 20 μm, ZnO is of a particle structure, and a particle size is 20 μm. In a coating-aluminum liquid contact layer, $ZrO_2$ accounts for 80%, $Al_2O_3$ accounts for 10%, ZnO accounts for 10%, a weight ratio of the binder to the materials is 15:1, and a painting thickness of the whole coating-aluminum liquid contact layer is required to be 1.0 mm.

The above specified materials are put into the mixing bucket for preliminary mixing, the rotation speed of the mixer is 200 revolutions per minute to obtain a preliminarily-mixed material, then, the obtained preliminarily-mixed material is quickly mixed, the binder needs to be added in a rapid mixing stage, the weight ratio of the binder to the materials is 15:1, the rotation speed of the mixer is 300 revolutions per minute to obtain a coating-aluminum liquid contact layer coating, the coating is used for painting the riser tube, and a coating thickness is 1.0 mm.

After coating painting of the coating-riser tube contact layer and the coating-aluminum liquid contact layer is finished, the riser tube is dried for 2h and then placed in a warm box for heating. Drying is mainly divided into two stages, parameters of a first-stage drying heat treatment process are holding temperature being 250° C. and holding time being 6 h. Parameters of a second-stage drying heat treatment process are holding temperature being 300° C. and holding time being 3 h. A riser tube with a coating coverage layer is finally obtained.

EMBODIMENT 2

Embodiments of the present invention provide a riser tube coating for a cast aluminum alloy and a using method thereof. A coating material is mainly composed of $ZrO_2$, $Al_2O_3$, ZnO and a binder, and proportions of which are weight percentages.

A coating-riser tube contact layer material is mainly $ZrO_2$, $Al_2O_3$, ZnO and a binder, $ZrO_2$ is of a particle structure, a particle size is 70 μm, $Al_2O_3$ is of a particle structure, a particle size is 60 μm, ZnO is of a particle structure, and a particle size is 60 μm. In a coating-riser tube contact layer, $ZrO_2$ accounts for 80%, $Al_2O_3$ accounts for 10%, ZnO accounts for 10%, a weight ratio of the binder to the materials is 10:1, and a painting thickness of the whole coating-riser tube contact layer is required to be 1.0 mm.

The above specified materials are put into a mixing bucket for preliminary mixing, a rotation speed of a mixer is 200 revolutions per minute to obtain a preliminarily-mixed material, then, the obtained preliminarily-mixed material is rapidly mixed, the binder needs to be added in a rapid mixing stage, the weight ratio of the binder to these materials is 10:1, the rotation speed of the mixer is 300 revolutions per minute to obtain a coating-riser tube contact layer coating, the coating is used for painting the riser tube, and a coating thickness is 1.0 mm.

A coating-aluminum liquid contact layer material is mainly $ZrO_2$, $Al_2O_3$, ZnO and a binder, $ZrO_2$ is of a particle structure, a particle size is 50 μm, $Al_2O_3$ is of a particle structure, a particle size is 30 μm, ZnO is of a particle structure, and a particle size is 30 μm. In a coating-aluminum liquid contact layer, $ZrO_2$ accounts for 90%, $Al_2O_3$ accounts for 5%, ZnO accounts for 5%, a weight ratio of the binder to the materials is 15:1, and a painting thickness of the whole coating-riser tube contact layer is required to be 1.5 mm.

The above specified materials are put into the mixing bucket for preliminary mixing, the rotation speed of the mixer is 200 revolutions per minute to obtain a preliminarily-mixed material, then, the obtained preliminarily-mixed material is rapidly mixed, the binder needs to be added in a rapid mixing stage, the weight ratio of the binder to the materials is 15:1, the rotation speed of the mixer is 300 revolutions per minute to obtain a coating-aluminum liquid contact layer coating, the coating is used for painting the riser tube, and a coating thickness is 1.5 mm.

After coating painting of the coating-riser tube contact layer and the coating-aluminum liquid contact layer is finished, the riser tube is dried for 2 h and then placed in the warm box for heating. Drying is mainly divided into two stages, parameters of a first-stage drying heat treatment process are holding temperature being 350° C. and holding time being 5 h. Parameters of a second-stage drying heat treatment process are holding temperature being 400° C. and holding time being 2 h. A riser tube with a coating coverage layer is finally obtained.

EMBODIMENT 3

Embodiments of the present invention provide a riser tube coating for a cast aluminum alloy and a using method thereof. A coating material is mainly composed of $ZrO_2$, $Al_2O_3$, ZnO and a binder, and proportions of which are weight percentages. A coating-riser tube contact layer material is mainly $ZrO_2$, $Al_2O_3$, ZnO and a binder, $ZrO_2$ is of a particle structure, a particle size is 60 μm, $Al_2O_3$ is of a particle structure, a particle size is 50 μm, ZnO is of a particle structure, and a particle size is 50 μm. In a coating-riser tube contact layer, $ZrO_2$ accounts for 75%, $Al_2O_3$ accounts for 13%, ZnO accounts for 12%, a weight ratio of the binder to the materials is 10:1, and a painting thickness of the whole coating-riser tube contact layer is required to be 0.8 mm. The above specified materials are put into a mixing bucket for preliminary mixing, a rotation speed of a mixer is 200 revolutions per minute to obtain a preliminarily-mixed material, then, the obtained preliminarily-mixed material is rapidly mixed, the binder needs to be added in a rapid mixing stage, the weight ratio of the binder to the materials is 10:1, the rotation speed of the mixer is 300 revolutions per minute to obtain a coating-riser tube contact layer coating, the coating is used for painting the riser tube, and a coating thickness is 0.8 mm.

A coating-aluminum liquid contact layer material is mainly $ZrO_2$, $Al_2O_3$, ZnO and a binder, $ZrO_2$ is of a particle structure, a particle size is 40 μm, $Al_2O_3$ is of a particle structure, a particle size is 25 μm, ZnO is of a particle structure, and a particle size is 28 μm. In a coating-aluminum liquid contact layer, $ZrO_2$ accounts for 85%, $Al_2O_3$ accounts for 8%, ZnO accounts for 7%, a weight ratio of the binder to the materials is 15:1, and a painting thickness of the whole coating-riser tube contact layer is required to be 1.2 mm.

The above specified materials are put into the mixing bucket for preliminary mixing, a rotation speed of the mixer is 200 revolutions per minute to obtain a preliminarily-mixed material, then, the obtained preliminarily-mixed material is rapidly mixed, the binder needs to be added in a rapid mixing stage, the weight ratio of the binder to the materials is 15:1, the rotation speed of the mixer is 300 revolutions per minute to obtain a coating-aluminum liquid contact layer coating, the coating is used for painting the riser tube, and a coating thickness is 1.2 mm.

After coating painting of the coating-riser tube contact layer and the coating-aluminum liquid contact layer is finished, the riser tube is dried for 2 h and then placed in the warm box for heating. Drying is mainly divided into two stages, parameters of the first-stage drying heat treatment process are holding temperature being 300° C. and holding time being 5.5 h. Parameters of the second-stage drying heat treatment process are holding temperature being 350° C. and holding time being 2.5 h. A riser tube with a coating coverage layer is finally obtained.

TABLE 1 normal riser tube and embodiment data comparison table

| Comparison data | Accumulated service life | Aluminum sticking weight | Replacement and cleaning frequency | Cleaning time |
|---|---|---|---|---|
| Normal riser tube | 60 days | 2.81 Kg | 5 days/time | 2.1 h |
| Embodiment 1 | 112 days | 0.41 Kg | 10 days/time | 32 min |
| Embodiment 2 | 110 days | 0.39 Kg | 12 days/time | 30 min |
| Embodiment 3 | 112 days | 0.40 Kg | 11 days/time | 32 min |

Statistics are performed on comparison data between a normal riser tube and the embodiments in the Table 1 above. It can be seen from Table 1 that the normal riser tube has a short accumulated service life, a large aluminum sticking weight, a high replacement and cleaning frequency and difficulty cleaning, while the accumulated service life, the aluminum sticking weight, the replacement and cleaning frequency and cleaning time of the Embodiment 1, the Embodiment 2 and the Embodiment 3 have been greatly improved. Thus, it may be illustrated that that the coating and the using method of the coating of the present invention can prolong the service life of the riser tube, reduce the aluminum sticking on the inner wall, reduce the replacement frequency, and reduce the cleaning difficulty and time. Therefore, the present invention has the advantages of having good protectiveness for the riser tube, being free of aluminum sticking, prolonging the service life, and being environmentally-friendly.

Compared with the prior art, the riser tube coating for the cast aluminum alloy and the using method thereof of the present invention have the following advantages:

at present, in the production process of antigravity casting of the cast aluminum alloy, the high temperature metal liquid in the crucible or holding furnace enters the mold cavity through the riser tube under the action of the gas pressure, the metal liquid stays in the riser tube for the period of time in the pressure maintaining stage, and with the pressure relief of the gas in the crucible or the holding furnace, the metal liquid in the riser tube will flow into the crucible or the holding furnace again. The metal liquid enters the riser tube, and forms thermal impact on the inner wall of the riser tube, which easily causes cracking and thermal erosion of the riser tube. In this process, the interface of the riser tube and the metal liquid is seriously eroded, and part of the riser tube material will fall and enter the metal liquid; then the high temperature metal liquid is oxidized due to making contact with the air, and stuck to the inner wall and the outer wall of the riser tube, resulting in reduction of the life of the riser tube; and once again, the slag inclusions inside the high-temperature molten metal are easily bonded to the inner wall of the riser tube due to repeated scouring in the riser tube. Because the metal liquid reacts in a high-temperature situation and forms aluminum sticking, subsequent cleaning of the riser tube needs high-temperature baking, cleaning is very difficult, and labor intensity and production cost are seriously increased. For solving the above problems, the present invention provides the riser tube coating resistant to high temperature, resistant to thermal impact, free of aluminum sticking, good in protection, capable of prolonging the life and environmentally-friendly.

(1), $ZrO_2$, $Al_2O_3$, ZnO, the binder and other materials used in the present invention have a high melting point and are easily prepared into the coating. Through design of parameters such as a shape, a size and a proportion of the materials, it can be ensured that the coating has a protective effect on the riser tube. According to the statistics, under the current production process conditions, a riser tube without the coating needs to be disassembled and cleaned every 5 days, and the accumulated service life is about 60 days. However, the riser tube treated by the coating and a baking method designed by the present invention should be cleaned after 10 days, the coating is painted again, and the accumulated service life can reach 110 days. After calculating the price and life of the riser tube used by the factory, the monthly cost of the riser tube can be saved by about 48,000 yuan. Therefore, it can be illustrated that the present invention has good protection, life prolonging and cost saving effects on the riser tube.

(2), by applying the coating designed in the present invention to brush the riser tube and performing baking according to the baking process, inner wall slag hanging of the riser tube can be effectively reduced, and the removal of the inner wall hanging slag does not require high temperature heating, so as to greatly improve the working environment and reduce labor intensity. By comparing an aluminum sticking weight of the riser tube without using the coating with that of the riser tube using the coating of the present invention, it may be found that the weight of the riser tube without using the coating is increased by about 2.8 Kg when scrapped, and the weight of the riser tube using the coating of the present invention is increased by 0.4 Kg when scrapped. Accordingly, it may be seen that the coating of the present invention can prevent the aluminum slag from sticking in the inside of the riser tube and reduce the mass loss of the aluminum liquid. There is a difference in cleaning time between the riser tube without using the coating and the riser tube using the coating of the present invention. The riser tube without using the coating needs to be roasted at a high temperature for 4 h and cleaned for 2 h. The riser tube using the coating of the present invention does not need high temperature baking in the cleaning process, and the cleaning time is 30 min. Therefore, the coating designed by the present invention can achieve the effects of being free of aluminum sticking on the inner wall of the riser tube, reducing slagging, saving cost and being environmentally friendly.

(3), the materials in the coating designed in the present invention and a device used in the baking process are conventional materials. The production process of the refractory materials is mature and stable, so the cost of the riser tube will not be increased. Therefore, the present invention has the advantages of easy realization, economy and practicality.

In the descriptions of the present invention, it needs to be understood that an orientation or position relationship indicated by terms "center", "longitudinal", "transverse", "front", "back", "left", "right", "vertical", "horizontal", "top", "bottom", "inside", "outside", etc. does not indicate or imply that a referred apparatus or element must have a particular orientation or be constructed and operated for the particular orientation, and therefore, it cannot be understood as the limitation to the protection content of the present invention.

Furthermore, terms "first" and "second" are merely used for descripting purposes and are not to be understood as indicating or implying relative importance or as implicitly indicating the number of technical features indicated. Thus, a feature defined as "first" or "second" may explicitly or implicitly include one or more the features. In the description of the present invention, "a plurality of" means at least two, such as two, three, etc., unless otherwise clearly and specifically limited.

In the present invention, unless otherwise clearly specified and limited, terms "installation", "connection", "link", "fixing", etc. shall be understood broadly, for example, may be fixed connection, may also be detachable connection, or may be integrated connection; may be mechanical connection, may also be electric connection or may be intercommunication; and may be direct connection, may also be indirect connection through an intermediation, and may be communication inside two elements or an interaction relation of two elements. For those ordinarily skilled in the art, the specific meanings of the above terms in the present invention may be understood according to the specific circumstances.

The above is only an exemplary embodiment of the present invention and is not used to limit the present invention. Any modification, equivalent substitution, improvement, etc. made within the spirit and principles of the present invention shall be included in the scope of protection of the present invention.

What is claimed is:

1. A riser tube coating for a cast aluminum alloy, characterized by comprising a coating-riser tube contact layer material and a coating-aluminum liquid contact layer material, wherein the coating-riser tube contact layer material comprises $ZrO_2$, $Al_2O_3$, ZnO and a binder, $ZrO_2$ accounts for 70%-80%, $Al_2O_3$ accounts for 10%-15%, ZnO accounts for 10%-15%, and a weight ratio of the binder to the materials is 10:1; and the coating-aluminum liquid contact layer material is mainly $ZrO_2$, $Al_2O_3$, ZnO and a binder, in the coating-aluminum liquid contact layer material, the $ZrO_2$ accounts for 80%-90%, $Al_2O_3$ accounts for 5%-10%, ZnO accounts for 5%-10%, and a weight ratio of the binder to the materials is 15:1.

2. The riser tube coating for the cast aluminum alloy according to claim 1, characterized in that $ZrO_2$ in the coating-riser tube contact layer material is of a particle structure, a particle size is 50 μm-70 μm, $Al_2O_3$ is of a particle structure, a particle size is 40 μm-60 μm, ZnO is of a particle structure, and a particle size is 40 μm-60 μm.

3. The riser tube coating for the cast aluminum alloy according to claim 2, characterized in that a thickness of the coating-riser tube contact layer material is 0.5 mm-1.0 mm.

4. The riser tube coating for the cast aluminum alloy according to claim 1, characterized in that $ZrO_2$ in the coating-aluminum liquid contact layer material is of a particle structure, a particle size is 30 μm-50 μm, $Al_2O_3$ is of a particle structure, a particle size is 20 μm-30 μm, ZnO is of a particle structure, and a particle size is 20 μm-30 μm.

5. The riser tube coating for the cast aluminum alloy according to claim 4, characterized in that a thickness of the coating-aluminum liquid contact layer material is 1.0 mm-1.5 mm.

* * * * *